United States Patent [19]

Marks

[11] 4,062,541

[45] Dec. 13, 1977

[54] PADDLE CONSTRUCTION

[75] Inventor: Nathan Marks, Englewood Cliffs, N.J.

[73] Assignee: Marcraft Recreation Inc., Garfield, N.J.

[21] Appl. No.: 661,235

[22] Filed: Feb. 25, 1976

[51] Int. Cl.[2] ..... A63B 49/12

[52] U.S. Cl. ..... 273/73 C; 273/67 R; 273/73 R; 273/76

[58] Field of Search ..... 273/67 R, 67 A, 67 B, 273/72 R, 73 R, 73 C, 73 F, 73 K, 76, 82 R, 82 B; 280/610

[56] References Cited

U.S. PATENT DOCUMENTS

| | | | |
|---|---|---|---|
| 2,191,287 | 2/1940 | Perryman | 273/76 |
| 2,311,546 | 2/1943 | Hurt | 273/76 |
| 2,328,366 | 8/1943 | Timmermann | 273/76 |
| 2,471,316 | 5/1949 | Diehl | 273/82 R |
| 2,626,804 | 1/1953 | Robinson | 273/73 F |
| 2,818,057 | 12/1957 | Meyer et al. | 273/73 F X |
| 3,353,258 | 11/1967 | Barton et al. | 273/72 R X |
| 3,635,483 | 1/1972 | Barriball et al. | 273/73 F X |
| 3,879,035 | 4/1975 | Danchulis et al. | 273/73 C |
| 3,879,250 | 4/1975 | Rankin | 273/67 R X |

FOREIGN PATENT DOCUMENTS

| | | | |
|---|---|---|---|
| 802,060 | 5/1936 | France | 273/73 R |
| 998,816 | 9/1951 | France | 273/76 |
| 592,005 | 9/1947 | United Kingdom | 273/76 |
| 607,255 | 8/1948 | United Kingdom | 273/76 |

*Primary Examiner*—Richard J. Apley

*Attorney, Agent, or Firm*—Blum, Moscovitz, Friedman & Kaplan

[57] ABSTRACT

An improved game paddle construction, utilizing a wood core and metal skin layers is provided. The wood core defines an integrated blade portion and handle portion, the blade portion of the wood core having a uniform thickness defined by opposed substantially planar surfaces. The first and second metal skin layers are respectively bonded to the opposed surfaces of the wood core to substantially sandwich the entire blade portion of the wood core therebetween. A grip is secured to the handle portion, the grip surrounding a substantial lengthwise extent of the handle portion.

10 Claims, 4 Drawing Figures

PADDLE CONSTRUCTION

BACKGROUND OF THE INVENTION

This invention is directed to an improved game paddle, and in particular, to an improved game paddle having a wood core sandwiched between two metal skin layers.

Heretofore, in outdoor paddle sports, such as paddleball, platform tennis, and the like, the playability and sensitivity of wood has caused a reluctance on the part of players to utilize paddles made of materials other than wood. Nevertheless, wood is subject to weathering (cracking, warping, chipping, etc.) particularly after the protective coating provided by the manufacturer is worn away through constant use. Moreover, because the thickness of a wood paddle blade must be such as to provide sufficient strength, efforts in lightening the weight of the paddle blade by reducing the thickness thereof have been less than completely satisfactory. Although paddles formed entirely of metal, with a core of honeycombed aluminum have been proposed for providing a lighter paddle, the playability and sensitivity of wood is lost. Accordingly, a paddle construction capable of obtaining the playability and sensitivity of wood and having the rigidity and strength of metal is desired.

SUMMARY OF THE INVENTION

Generally speaking, in accordance with the instant invention, a game paddle construction formed by sandwiching a wood core between two metal skin layers is provided. The wood core defines an integrated blade portion and handle portion, the blade portion of the wood core having a uniform thickness defined by opposed substantially planar surfaces. First and second metal skin layers are bonded to at least the opposed substantially planar surfaces of the wood core to sandwich substantially all of the blade portion of the wood core therebetween. A grip is secured to the handle portion to surround a substantial lengthwise extent of the handle portion.

Accordingly, it is an object of this invention to provide an improved game paddle construction utilizing metal and wood.

A further object of this invention is to provide a playable, highly sensitive, rigid and lightweight paddle construction.

Still a further object of this invention is to provide an improved paddle construction for reducing weathering, yet affording lightness and improved playability.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
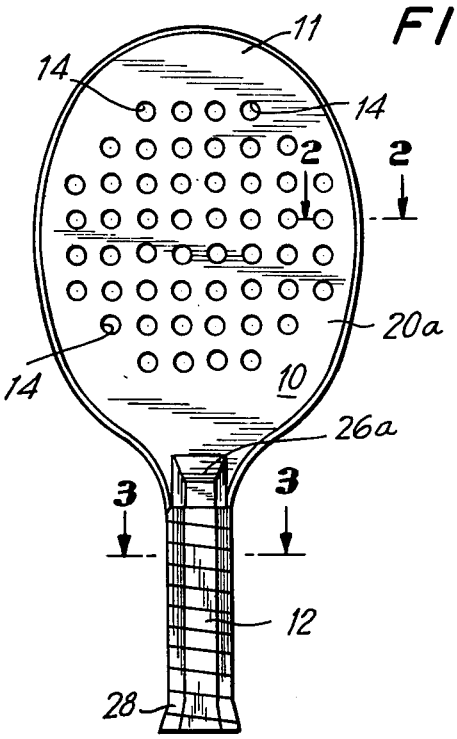
FIG. 1 is a plan view of a game paddle constructed in accordance with the instant invention.

Reference is now made to FIG. 1, wherein a game paddle generally indicated as 10, is depicted. The game paddle 10 includes a blade portion 11 and handle portion 12. The blade portion 11 includes a plurality of through holes 14, the exact number of holes being determined by the particular game effects sought to be obtained and the particular game to be played therewith.

Figure 2:
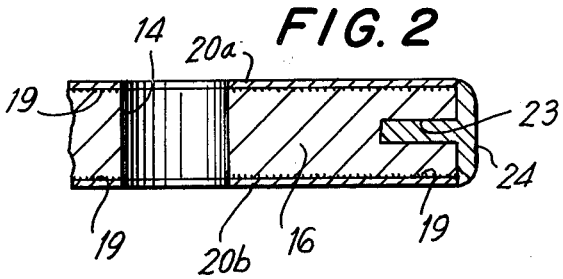
FIG. 2 is a partial sectional view taken along line 2—2 of FIG. 1.
Figure 3:
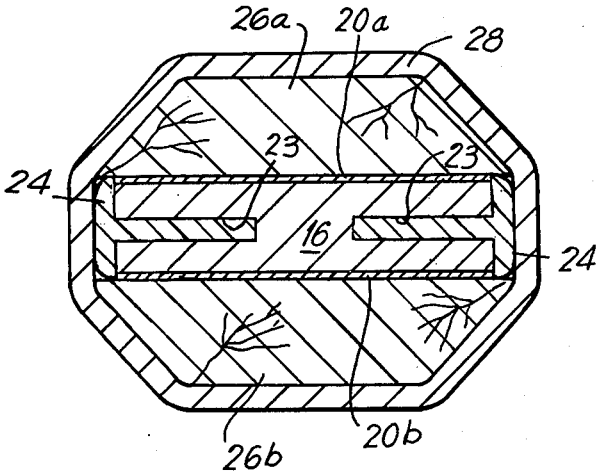
FIG. 3 is a sectional view taken along line 3—3 of FIG. 1.
Figure 4:
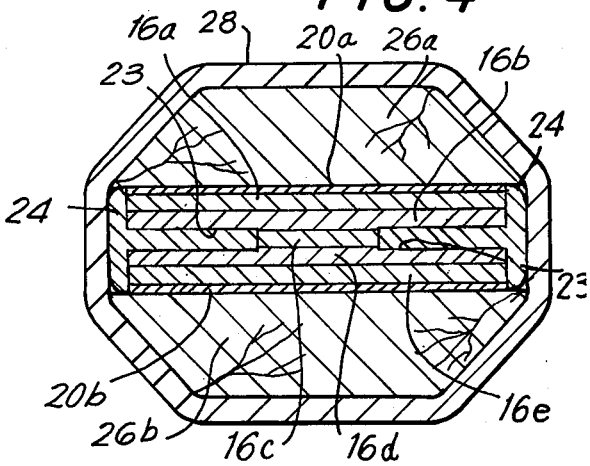
FIG. 4 is a sectional view of a game paddle constructed in accordance with an alternate embodiment of the instant invention.

Referring to FIGS. 1 through 3, the paddle 10 includes a wood core 16 formed of balsa wood, rock maple, fir, or the like. Alternatively, as illustrated in FIG. 4, the wood core can be formed from a plurality of laminated wood core layers **16*a* through 16*e*, the respective layers being formed from one of, or a combination of, the woods listed above. In a preferred embodiment, the wood is formed with a uniform thickness and defines the shape of the blade portion and length of the handle portion. Two metal skin layers 20*a* and 20*b* each having a thickness on the order of 0.005 mils and 0.325 mils, are adhesively bonded to the opposed surfaces of wood core 16 by a layer 19 of glue or other well-known bonding agents. Accordingly, the respective skin layers 20*a* and 20*b* entirely cover both opposed planar surfaces of the wood core 16 to thereby sandwich the wood core therebetween. The wood core includes a slot 23 peripherally surrounding the blade and handle portions. The slot permits a metal rim 24** having a T-shaped cross-section to be inserted therein and appropriately secured thereto to cover the edge surfaces of the metal skin layers and wood core sandwiched therebetween, and thereby protect same during use of the game paddle.

The handle portion formed by the metal skin layers and wood core are sandwiched between two elongated half-handles **26*a* and 26*b*, the half-handles being secured to the handle portion along a substantial lengthwise extent thereof. Thereafter a suitable grip material 28** such as leather or the like is wrapped around the half-handles and handle portion therebetween in a conventional manner to thereby provide a finished paddle construction.

As detailed above, the wood core can be formed of balsa wood, rock maple, fir or any suitable combination of these materials. Additionally, as illustrated in FIG. 4, different materials or laminates thereof can be utilized in combination to define the wood core. In preferred embodiment, the metal skin layer is formed of an aluminum alloy, but any other metal having high tensile strength, such as magnesium, that is capable of forming a lightweight, durable, extremely thin layer is suitable for use in the instant invention.

It is noted that a game paddle having metal skin layers and a wood core constructed in accordance with the instant invention has the advantage of having superior playing surfaces that are not subject to the same degree of weathering as wood and thereby insures less wear and tear to the game paddle during use. Moreover, the use of metal skin layers permits a much lighter and stronger paddle to be manufactured. Finally, all these benefits obtain without losing the proven playability and sensitivity of wood that has heretofore resulted in paddle constructions utilizing metal therein. Accordingly, a conventional 17-inch paddle having a preferred thickness of three-eighth inches with a playlength of 10⅜ inches is readily provided by the instant invention. Moreover, a lightweight paddle weighing 13 oz. or less can be provided without any loss in strength, playability or sensitivity by the player.

It is further noted that although the instant invention has been described herein as an integrated blade portion and handle portion defined by the wood core, the instant invention is particularly adapted to provide an improved paddle construction wherein a blade portion constructed in accordance with the instant invention is secured by appropriate means to a separate conventional handle assembly.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. A game paddle construction comprising in combination a blade portion, said blade portion including a core consisting essentially of wood having a uniform thickness defined by opposed substantially planar surfaces, and first and second metal skin layers bonded to said opposed planar surfaces of said wood core for defining the striking surfaces of said game paddle, said blade portion including a plurality of through holes therein, each of said through holes being defined by said wood core and said metal skin layers, and handle means affixed to said blade portion, said handle means including grip means surrounding a substantial lengthwise extent of said handle means.

2. A game paddle construction as claimed in claim 1 wherein said wood core is formed from a plurality of laminated layers.

3. A paddle construction as claimed in claim 2, wherein each said laminated layer of said wood core is selected from the group comprising balsa wood, rock maple, and fir.

4. A paddle construction as claimed in claim 3, wherein said wood core includes recess means peripherally surrounding at least said entire blade portion, and a metal rim disposed in said recess means for protecting said blade portion of said wood core and said metal skin layers adjacent said rim.

5. A game paddle construction as claimed in claim 1, wherein each said metal layer is formed of a metal alloy having a thickness of about 0.005 mils to 0.325 mils.

6. A game paddle construction as claimed in claim 5, wherein said metal skin layers are formed of an aluminum alloy.

7. A game paddle construction as claimed in claim 5, wherein metal layers are formed of magnesium.

8. A paddle construction as claimed in claim 1, wherein said wood core is selected from the group comprising balsa wood, rack maple, or fir.

9. A paddle construction as claimed in claim 1, wherein said grip means, includes two handle-halves, said handle halves being adapted to sandwich a substantial lengthwise extent of said handle means therebetween, and wrapping means for wrapping said handle to define a grip.

10. A paddle construction as claimed in claim 9, wherein the lengthwise extend of said wood core is no greater than 18 inches and said handle means is not greater than 7 inches.

* * * * *